US005409143A

United States Patent [19]

Sigel et al.

[11] Patent Number: 5,409,143

[45] Date of Patent: Apr. 25, 1995

[54] FLEXIBLE TUBE FOR THE PACKAGING OF PASTY PRODUCTS

[75] Inventors: Alwin Sigel, Schlatt; Walter Schibli, Hombrechtikon, both of Switzerland

[73] Assignee: Sika Robotics AG, Gruningen, Switzerland

[21] Appl. No.: 104,130

[22] PCT Filed: Nov. 30, 1992

[86] PCT No.: PCT/CH92/00234

§ 371 Date: Aug. 12, 1993

§ 102(e) Date: Aug. 12, 1993

[87] PCT Pub. No.: WO93/12012

PCT Pub. Date: Jun. 24, 1993

[30] Foreign Application Priority Data

Dec. 19, 1991 [CH] Switzerland ..... 03784/91

[51] Int. Cl.[6] ..... B65D 83/00; B65D 35/12

[52] U.S. Cl. ..... 222/183; 222/566

[58] Field of Search ..... 222/92, 105, 566, 570, 222/107

[56] References Cited

U.S. PATENT DOCUMENTS

| | | | |
|---|---|---|---|
| 2,101,855 | 12/1937 | Henderson . | |
| 2,612,224 | 9/1952 | Zabriskie | 222/566 X |
| 3,090,071 | 5/1963 | Le Brooy | 222/107 X |
| 3,128,913 | 4/1964 | Specketer | 222/566 X |
| 3,552,607 | 1/1971 | Edwards | 222/566 |
| 3,656,668 | 4/1972 | Liebertz | 222/107 X |
| 3,794,213 | 2/1974 | Schwartzman | 222/107 |
| 3,874,558 | 4/1975 | Rockefeller | 222/92 |
| 4,028,156 | 6/1977 | Clark et al. | 222/566 X |
| 4,223,810 | 9/1980 | Sneider | 222/107 |
| 4,776,488 | 10/1988 | Gurzan | 222/107 X |

FOREIGN PATENT DOCUMENTS

| | | |
|---|---|---|
| 1161905 | 3/1958 | France . |
| 2395197 | 1/1979 | France . |

*Primary Examiner*—Andres Kashnikow
*Assistant Examiner*—Kenneth DeRosa
*Attorney, Agent, or Firm*—Anderson Kill Olick & Oshinsky

[57] ABSTRACT

The object of the invention is a container (1) especially for chemical substances consisting of a substance chamber (2) of tubular plastic film (10) and a funnel-shaped headpiece (3). The film consists of low-density and the headpiece of high-density plastic. The tubular plastic film (10) is secured in the headpiece (3) by pressing. The headpiece (3) may be divided into a plate-shaped (4) and a tubular (5) section. On the side towards the substance chamber, the plate-shaped section (4) has an annular groove. The plastic film (10) is pressed into place by a securing ring with a U-shaped cross-section which can be pressed into the annular groove. A snap mechanism holds the securing ring firmly in the groove. The tubular plastic film (10) is firmly pressed between the securing ring and the groove walls. The container (1) can be closed at the rear by a suitable closure device.

10 Claims, 3 Drawing Sheets

FLEXIBLE TUBE FOR THE PACKAGING OF PASTY PRODUCTS

BACKGROUND OF THE INVENTION

In various industries it is often necessary to transfer chemical substances from one container to another, or to inject them into a cavity. For example, hand-cleaning fluids have to be poured from a storage container into a soap dispenser, lubricating oil from a storage can into a grease-gun or polishing paste from a storage drum into the container of a polishing machine. An example of injecting chemical substances into cavities is the use of insulation or filler materials in construction to fill gaps or holes. Another example is repairing damaged effluent pipes by injecting filler materials into cracks or couplings in the pipe wall.

Present-day technology uses plastic, metal or glass funnels for transferring chemical substances from one container into another. However, these funnels are suitable primarily for fluid or powdered substances, rather than for pasty materials. There is also the risk of spillage with this method as the container being filled may overrun or the funnel may tilt. Spatulas can be used for transferring pasty substances, but this is a very laborious and time-consuming exercise. It also has the disadvantage that air may become trapped in the paste; this is a particular problem in the case of filler or insulating materials since entrapped air makes it impossible to achieve a perfect seal.

Funnels and spatulas have to be cleaned after use and, depending on the substance which has been transferred, conventional cleaning agents may be unsuitable. Solvents which may pollute the environment then have to be used.

Disposal problems arise when a chemical substance in a refill container has to be transferred to another container before it can be used. This is the case with lubricating oils, for example. These have to be transferred from a storage drum or bucket into a grease-gun. Another example is filler materials for pipe repairs; these have to be transferred from a storage container into the repair equipment. To avoid the empty refill containers (which previously held toxic substances) being classified as special waste, the residues of toxic substances have to be removed prior to disposal. This is a laborious process which often involves the use of solvents which are potentially damaging to the environment. If the chemical substance which has to be removed is a two-component material which hardens quickly, the container has to be cleaned immediately after emptying before the residues set.

It should also be mentioned that the person who transfers a substance or cleans the refill container comes into contact with the substance and the cleaning solvents, which may present a health risk. Chemical substances may cause burns, allergies, skin cancer or other illnesses. Cleaning solvents may damage the lungs and other respiratory organs.

A refill container was therefore sought which would allow substances to be transferred without using funnels or spatulas and which could be cleaned without difficulty.

Refill containers currently exist in the form of cylindrical cartridges made of aluminium or cardboard. The substances are expressed from such cartridges through a tube-like apparatus at one of the ends. This tube-like apparatus can be introduced without any problem into small openings in other containers. Use of a funnel is therefore unnecessary. However, these cartridges have relatively rigid walls and can be compressed only to a limited extent; substance residues therefore have to be washed out. The object of the invention was therefore to develop a container, particularly for chemical substances, which would allow these substances to be decanted without using funnels, spatulas or other apparatus.

SUMMARY OF THE INVENTION

The object of the invention is achieved by providing a container having a tubular portion for holding a pasty substance, and a funnel-shaped headpiece at an end of the tubular portion for decanting the substance, with the tubular section being formed of a flexible plastic film and the headpiece being formed of a rigid plastic material, and with the tubular portion being pressed into the headpiece so that it is retained therein. The tubular portion defines a substance chamber and is made of low-density plastic film. The funnel-shaped headpiece is made of high-density plastic. Disposable plastics such as polyethylene and polystyrol are the preferred manufacturing materials. The substance chamber is connected firmly with the headpiece. The invention is explained with the aid of Figures.

DETAILED DESCRIPTION OF THE PREFERRED EMBODIMENT

Figure 1:
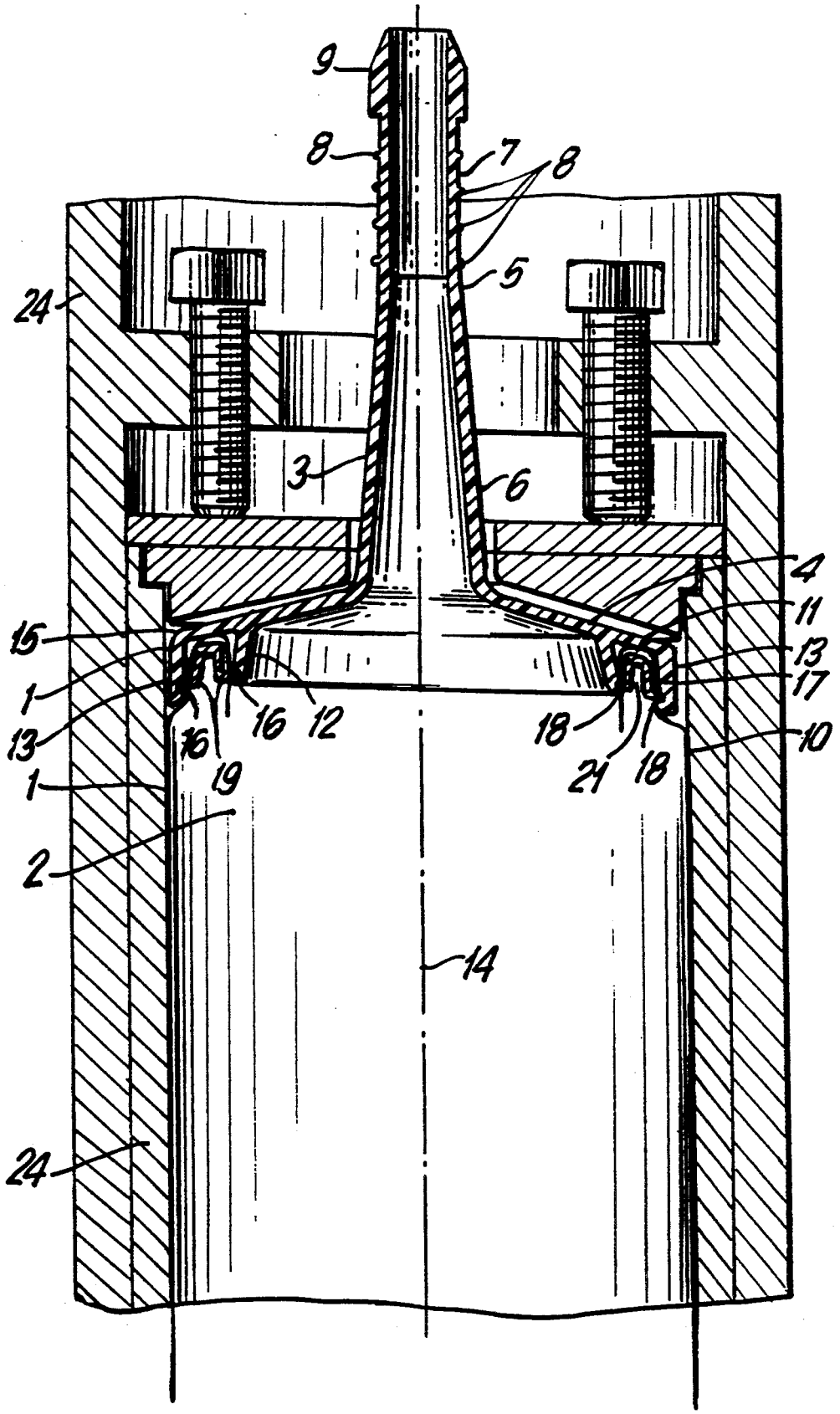
FIG. 1 Longitudinal section of a container inserted in the high-pressure holder of a pipe-repairing machine.

As already mentioned, the headpiece 3 of the container 1 is made of high-density plastic and is funnel-shaped in form. That section 4 of the headpiece 3 which is towards the substance chamber 2 is plate-shaped. Attached to the plate-shaped section 4 is a tubular section 5, through which the substances can be decanted from the container 1. That part 6 of the tubular section 5 which attaches to the plate-shaped section 4 is conical, while that part 7 which faces away from the plate-shaped section 4 is in the form of a hollow cylinder. On its outside, this part 7 has annular ridges 8 arranged at regular distances. The end 9 of the tubular section 5 is somewhat thicker than the cylindrical part 7. It is conical in shape and narrows towards the point. If the tubular section 5 is inserted into a cylindrical borehole of suitable diameter, the end 9 and the ridges 8 act as a type of barb or hook which holds the tubular section 5 firmly in place in the borehole.

The substance chamber 2 consists of tubular plastic film 10. One challenging problem which had to be solved by the invention was finding a way of fixing the thin film of low-density plastic 10 of the substance chamber 2 to the high-density plastic of the headpiece 3. Plastic cannot be glued and can only be welded under the condition that the parts to be welded have more or less the same mass. However, for the container 1 of this invention, this condition does not apply. The plastic of the headpiece 3 has a significantly greater mass than the plastic film 10 of the substance chamber 2. On welding, the low-density plastic film 10 of the substance chamber 2 would melt before the high-density plastic of the headpiece 3 had warmed up sufficiently.

Figure 2:
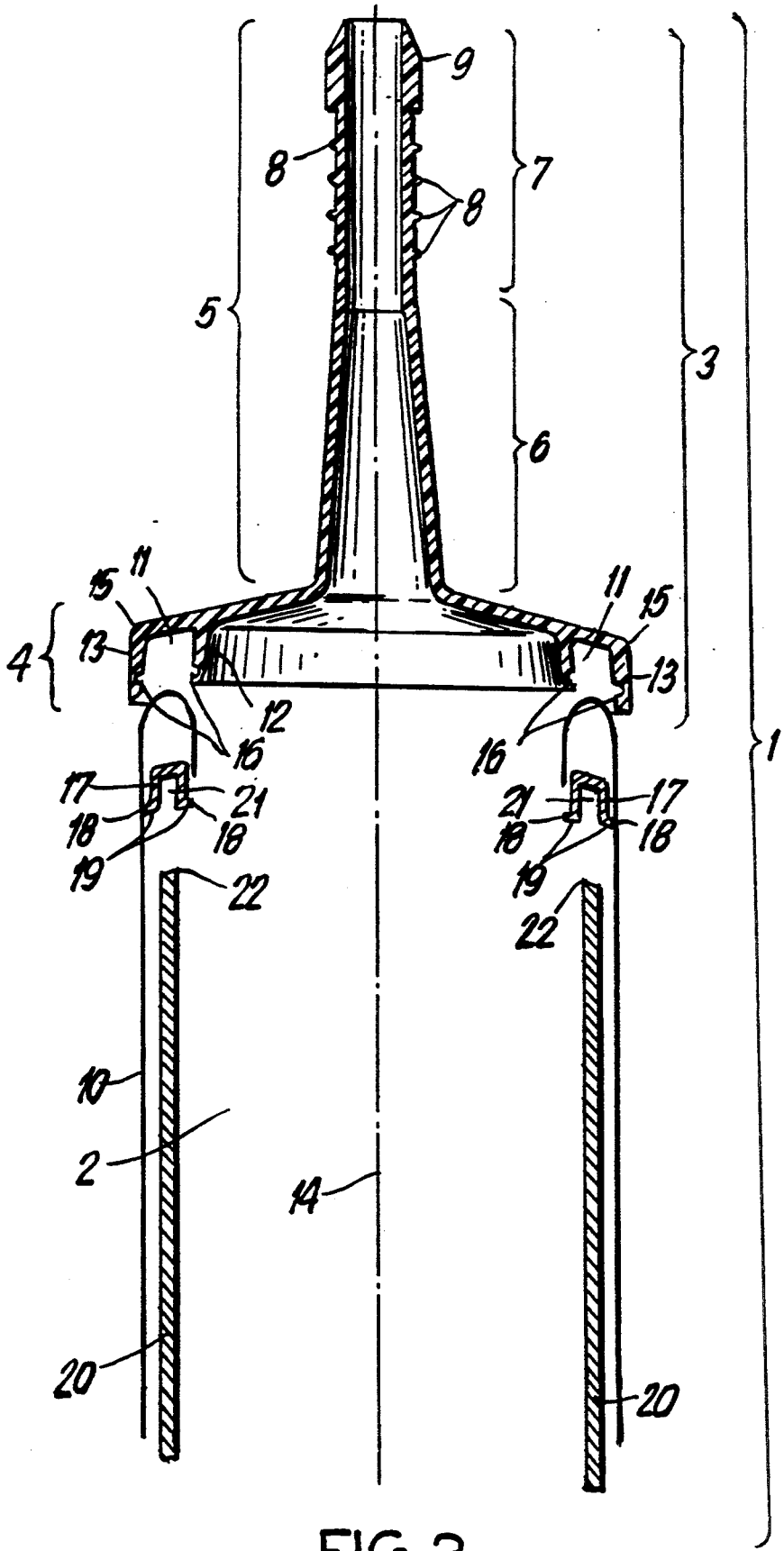
FIG. 2 Exploded diagram of a container. The individual components are shown in longitudinal section.

The above problem was solved in this invention by pressing the tubular plastic film 10 of the substance chamber 2 into the headpiece 3. For this purpose, the plate-shaped section 4 of the headpiece 3 has an annular groove 11 on the side which faces away from .the tubular section 5 and towards the substance chamber 2. This groove 11 consists of an inner side-wall 12 and an outer side-wall 13. The two side-walls 12 and 13 run parallel to the longitudinal axis 14 of the tubular section 5. Their spacing defines the width of the annular groove 11. The outer side-wall 13 is flush with the outer edge 15 of the plate-shaped section 4. Both side-walls 12 and 13 have an annular notch 16 at the same level on their inner side (cf. FIG. 2 ).

A securing ring 17 with U-shaped cross-section is used to press the plastic film 10 firmly into place. This securing ring 17 has a slightly smaller outer diameter than the outer diameter of the groove 11 of the headpiece 3. The width of the securing ring 17 is slightly less than the width of the groove 11. It has two annular ridges 18 on its outer side. These run along the two connecting edges 19 of the outer side of the ring. The two ridges 18 have a semicircular cross-section and a diameter corresponding to the width of the annular notch 16 of the headpiece 3.

It is now clear how the plastic film 10 is pressed firmly into place. The ends of the tubular plastic film 10 are looped over the securing ring 17 (cf. FIG. 2 ) and the ring 17 is then pressed into the groove 11 of the headpiece 3. The two ridges 18 of the securing ring 17 click into the two annular notches 16 of the headpiece 3. The plastic film 10 is then pressed firmly between the securing ring 17 and groove walls 12 and 13.

An auxiliary device is foreseen for pressing the securing ring 17 into the groove 11 on the headpiece 3. This consists of an assembly tube 20 with a diameter and wall thickness which are dimensioned in such a way that it can be inserted into the annular depresssion 21 of the securing ring 17 which is the result of its U-shaped cross-section. When assembling the container 1, the first step is to loop the tubular plastic film 10 over the assembly tube 20 until several centimetres of film overlap the tube. The securing ring 17 is then placed on the top edge 22 of the assembly tube. The upper loose section of the tubular plastic film 10 is then looped over the securing ring towards the inside. The headpiece 3 with its groove 11 is then placed on the securing ring 17 over which the plastic film is stretched. If pressure is then exerted from above onto the headpiece 3 or from below onto the assembly tube 20, the securing ring 17 is pressed into the groove 11 of the headpiece 3, where it snaps into place.

Figure 3:
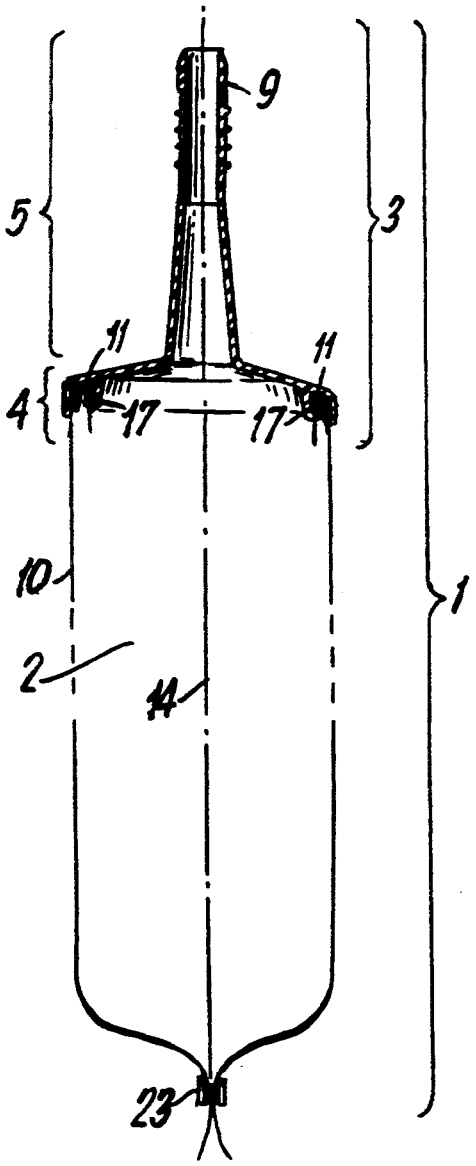
FIG. 3 Longitudinal section of a container closed at the rear with an adjustable band.
Figure 4:
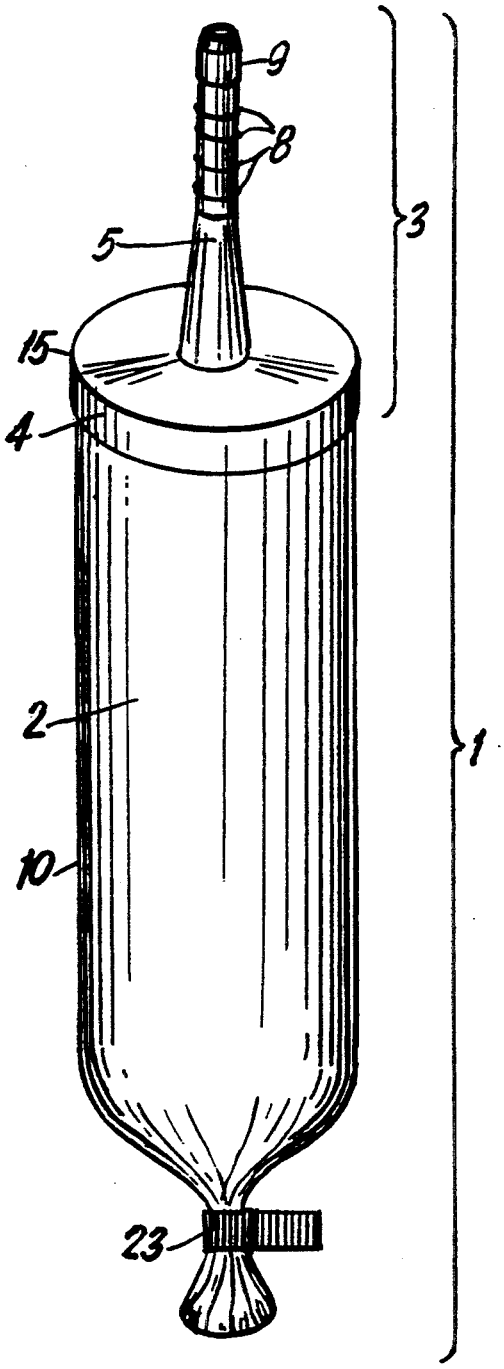
FIG. 4 Three-dimensional illustration of a filled container closed at the rear with an adjustable band.

Once the assembly tube 20 has been extracted from the securing ring 17 and the substance chamber 2, the container 1 is ready to be filled with a chemical substance. After filling, the tubular plastic film 10 is sealed at the end. A range of closure devices can be used for this purpose. The end can be tied with a string, or sealed with a clamp band 23 or clip (cf. FIGS. 3 and 4).

The container 1 of this invention has significant advantages over previous refill containers.

Thanks to the combination of a rigid headpiece 3, which functions as a funnel, with a flexible, compressible substance chamber 2, it is possible to transfer chemical substances from one container to another without using funnels or spatulas. This was not the case with cartridges used up till now. For filling, the tubular section 5 of the headpiece 3 is introduced into the appropriate opening of the container to be filled and the chemical substance is expressed pneumatically or hydraulically from the substance chamber 2. The empty container 1 can then be disposed of along with conventional domestic waste.

The container 1 allows clean transfer of substances without dirtying any tools or equipment. Cleaning involving potentially hazardous solvents is therefore no longer necessary. The headpiece 3 of the container 1 can withstand a pressure of 20 bars, which allows it to be used in hydraulic or pneumatic compressing apparatus. Equipment of this type is used, for example, in remotely controlled pipe repair machines. The container 1 can be emplaced directly in the cylindrical, high-pressure section 24 of such a machine. The tubular section 5 of the headpiece 3 extends out through a circular borehole in one of the ends of the high-pressure container 24 (cf. FIG. 1 ). The container 1 is compressed using pneumatically or hydraulically operated pistons and the filler material, for example epoxy resin, is pressed out of the container 1 through the tubular section 5 of the headpiece 3. The filler material does not come into contact with the compressing apparatus, meaning that the latter stays clean. Costly cleaning using solvents is no longer necessary. A further advantage of the container lies in the fact that the air between the container 1 and the wall of the high-pressure container 24 cannot mix with the filler material during the filling process. The air escapes down the side of the tubular section 5 of the headpiece 3 from the high-pressure container.

In closing, it can be added that the container 1 which forms the subject of this invention is not only practical, but also allows chemical substances to be handled in a way which is environmentally sound and presents no health hazard. Direct contact between the chemical substance and persons handling the container can be avoided and known and unknown health risks ruled out.

We claim:

1. A container for pasty substances comprising:

a tubular portion formed of a flexible plastic material film;

a headpiece formed of a rigid plastic material and having a plate-shaped section and funnel-shaped section; and means for fixedly connecting said tubular portion to said headpiece, said connecting means comprising:

spaced outer and inner side walls forming a part of said plate-shaped section located at a periphery of said plate-shaped section, extending in a direction opposite to a direction in which said funnel-shaped section extends, and defining a groove, a ring having a shape and dimensions complementary to a shape and dimensions of said groove for fixedly retaining an end of said tubular portion, which is folded over said ring, in said groove, said ring having an opening facing in the direction in which said outer and inner side walls of said plate-shaped section extend, for receiving a tool that provides for insertion of said ring into said grooves; and means for securing said ring in said groove.

2. A container according to claim 1, wherein the plastic material, said tubular portion and said head portion are made of is a plastic material selected from a group of plastic materials including polyethylen and polystyrol.

3. A container according to claim 1, wherein said flexible plastic material film is formed of low-density polyethylene, and said rigid plastic material is a high-density polyethylene.

4. A container according to claim 1, wherein said outer side wall extends flush with an outer edge of said plate-shaped section.

5. A container according to claim 1, wherein said groove and said ring have a U-shaped cross-section.

6. A container according to claim 1, wherein said securing means comprises a notch formed in an inner surface of at least one of said outer and inner side walls, and a ridge provided on an outer surface of said ring and extending into said notch, together with a portion of said film.

7. A container according to claim 1, wherein said funnel-shaped portion has a conical portion extending from said plate-shaped section, and a cylindrical portion, which forms a continuation of said conical portion.

8. A container according to claim 7, wherein said cylindrical portion has at least one ridge on an outer surface thereof.

9. A container according to claim 7, wherein said cylindrical portion has, at a free end thereof, a tapering point having a diameter which is larger than a diameter of said cylindrical portion.

10. A container according to claim 1, further comprising means for closing an end of said tubular portion remote from said headpiece, said closing means comprising one of a band, rope, and clip.

* * * * *